US010730592B2

(12) United States Patent
Kemp

(10) Patent No.: US 10,730,592 B2
(45) Date of Patent: Aug. 4, 2020

(54) POWERED WATERCRAFT

(71) Applicant: ASAP WATER CRAFTS LIMITED, West Bridgford, Nottingham (GB)

(72) Inventor: Ross William Kemp, West Bridgford (GB)

(73) Assignee: ASAP WATER CRAFTS LIMITED, Notthingham (GB)

( * ) Notice: Subject to any disclaimer, the term of this patent is extended or adjusted under 35 U.S.C. 154(b) by 0 days.

(21) Appl. No.: 16/312,431

(22) PCT Filed: Jun. 23, 2017

(86) PCT No.: PCT/EP2017/065612

§ 371 (c)(1),
(2) Date: Dec. 21, 2018

(87) PCT Pub. No.: WO2017/220811

PCT Pub. Date: Dec. 28, 2017

(65) Prior Publication Data

US 2019/0202533 A1 Jul. 4, 2019

(30) Foreign Application Priority Data

Jun. 23, 2016 (GB) ..... 1610960.5

(51) Int. Cl.
*B63B 32/10* (2020.01)
*B63C 11/46* (2006.01)
(Continued)

(52) U.S. Cl.
CPC ..... *B63B 32/10* (2020.02); *B63B 32/20* (2020.02); *B63B 34/10* (2020.02); *B63C 11/46* (2013.01)

(58) Field of Classification Search
CPC ... B63B 35/7943; B63B 35/731; B63B 35/81; B63C 11/46
See application file for complete search history.

(56) References Cited

U.S. PATENT DOCUMENTS 5,158,034 A 10/1992 Hsu
5,303,666 A * 4/1994 DeSantis ..... B63C 11/46 114/315

(Continued)

FOREIGN PATENT DOCUMENTS

WO 01/62347 A2 8/2001
WO 2014/111232 A1 7/2014

OTHER PUBLICATIONS

International Search Report Corresponding to PCT/EP2017/065612 dated Oct. 2, 2017.

(Continued)

*Primary Examiner* — Stephen P Avila
(74) *Attorney, Agent, or Firm* — Davis & Bujold PLLC; Michael J. Bujold

(57) ABSTRACT

A powered watercraft (1) for support and surface-transport of a user lying prone. The watercraft (1) has a hull (3) formed by a moulded shell (20) of expanded plastics strengthened by a metal framework (27) which extends lengthwise of the hull. The framework (27) has two arms (29) that extend laterally to hand-grips (10) on either side of the hull (3). The watercraft (1) is steered by shifting of the user's weight to one side or the other while gripping the hand-grips. The craft (1) is powered by an electric motor (5) coupled to a rearwardly-facing shrouded-propeller (4) on an underside (6) of the shell (20). Electronic motor controls are housed in a watertight metal box (31) incorporated into the framework (27), and motor-speed is regulated via lever mechanisms (9) at the hand-grips. Heat is dissipated via a heat-sink plate (42) exposed directly to the flow through the duct (7).

20 Claims, 6 Drawing Sheets

(51) Int. Cl.
*B63B 32/20* (2020.01)
*B63B 34/10* (2020.01)

(56) References Cited

U.S. PATENT DOCUMENTS

| | | | | |
|---|---|---|---|---|
| 6,152,062 | A * | 11/2000 | Hattori | B63B 29/04 114/343 |
| 6,461,204 | B1 | 10/2002 | Takura et al. | |
| 6,682,372 | B2 | 1/2004 | Grimmeisen | |
| 2001/0025594 | A1 | 10/2001 | Daniels | |
| 2015/0353175 | A1 | 12/2015 | Walpurgis | |

OTHER PUBLICATIONS

Written Opinion Corresponding to PCT/EP2017/065612 dated Oct. 2, 2017.

* cited by examiner

POWERED WATERCRAFT

This invention relates to powered watercraft and is concerned especially with powered watercraft for use by an individual on water for recreation, lifeguard and rescue services, and/or other purposes.

According to the present invention there is provided a powered watercraft which is for the support and surface-transport on water of a user lying prone on the watercraft, and which has a hull that comprises a moulded shell of expanded plastics material, wherein the moulded plastics shell is strengthened by a framework which extends lengthwise of the hull and which has two arms that extend laterally either side of the hull with hand-grips for gripping by the prone user in steering the watercraft at least in part by shift of his/her weight on the craft.

The moulded plastics material may be expanded polypropylene or other dense foam material.

The watercraft may be powered by a motor-driven propeller mounted within a duct on the underside of the hull. The motor may be electrically powered from a re-chargeable or other battery carried by the watercraft, with speed of the motor regulated via one or more controls operated from the hand-grips.

A dual-purpose powered watercraft according to the invention will now be described, by way of example, with reference to the accompanying drawings, in which.

Figure 1:
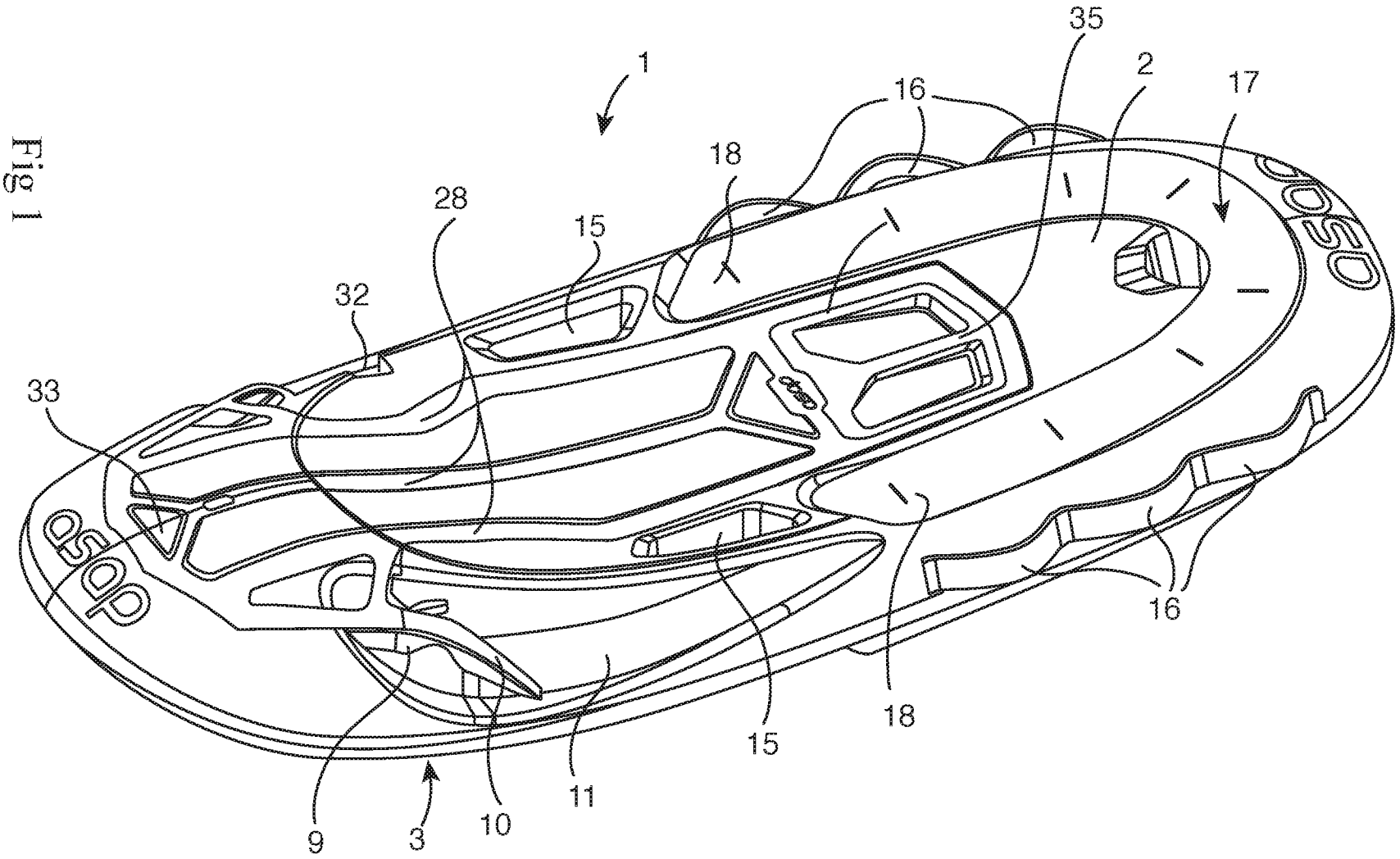
FIGS. 1 and 2 are perspective views above the left-hand side of the powered watercraft from its front and rear respectively.
Figure 2:
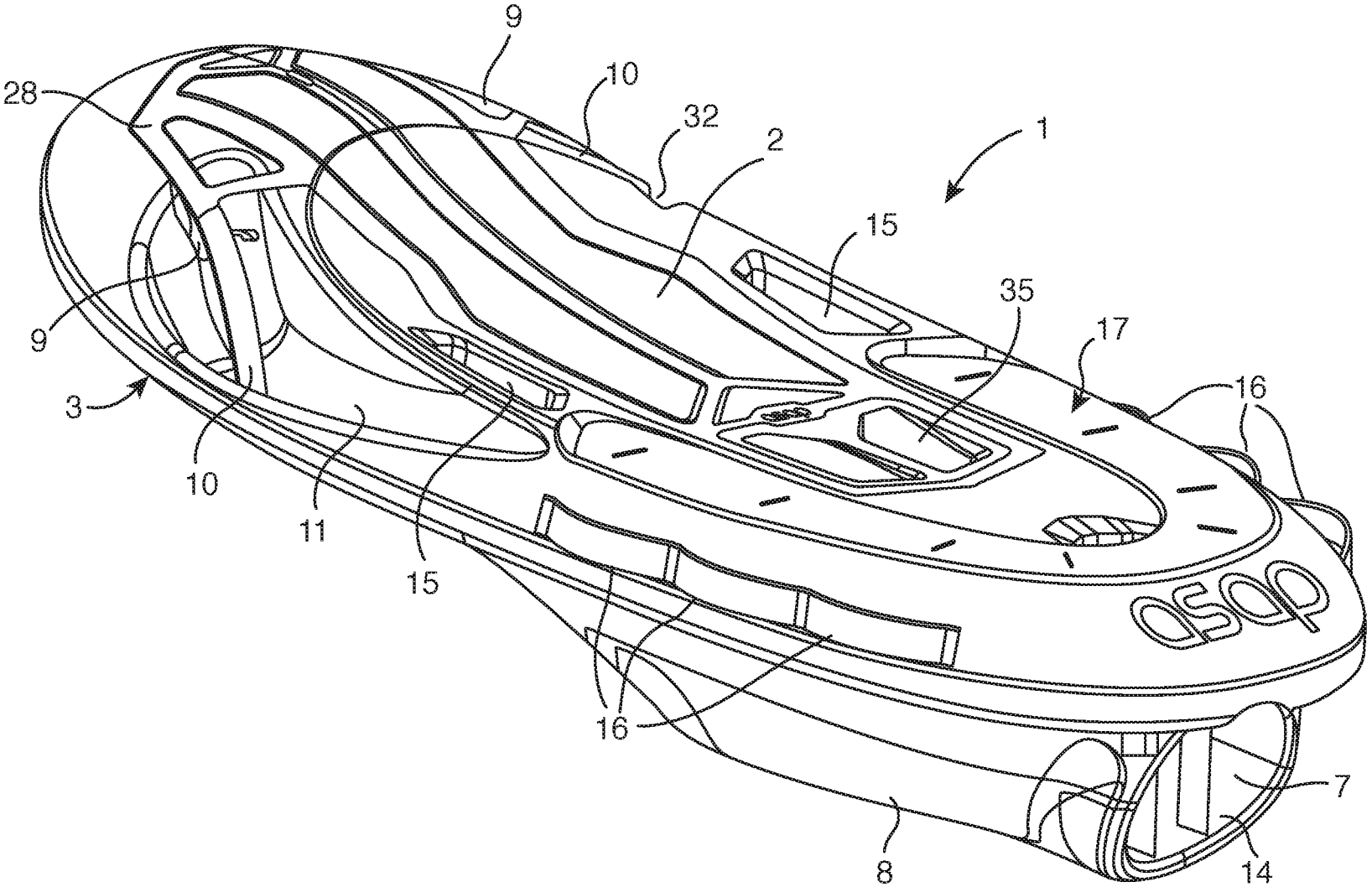
Figure 3:
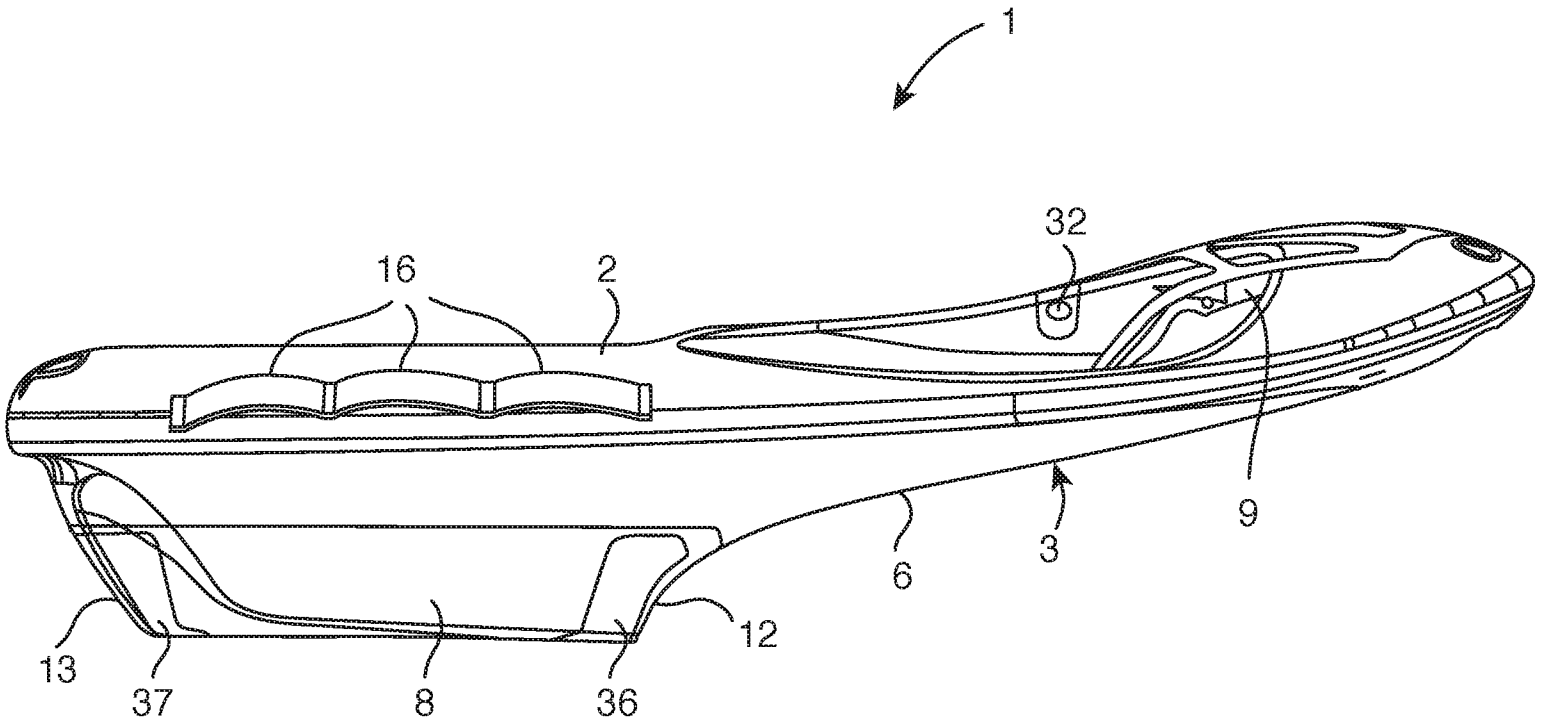
FIG. 3 is a view of the powered watercraft from its right-hand side.
Figure 4:
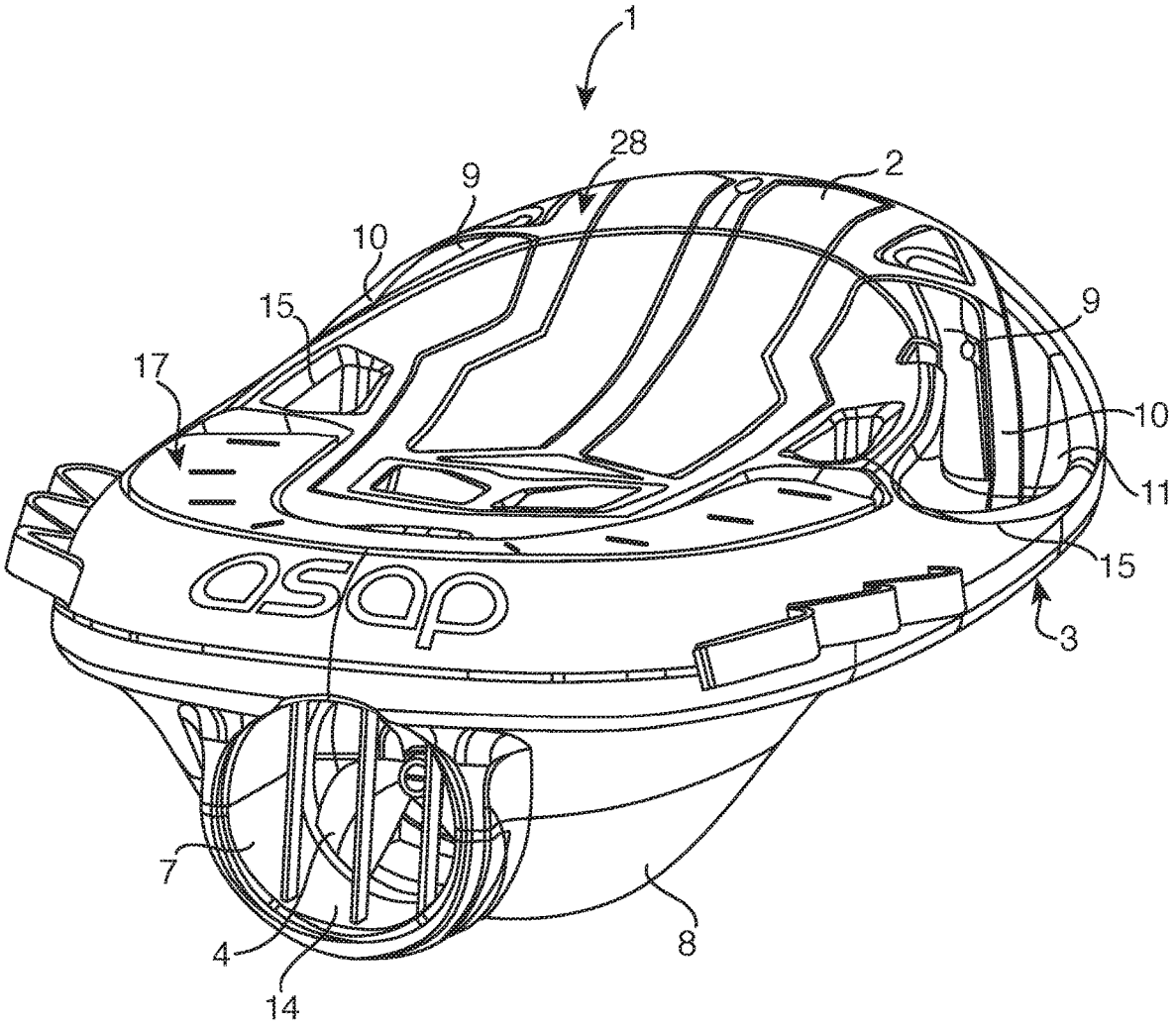
FIG. 4 is a rear view from the right-hand side of the powered watercraft.
Figure 5:
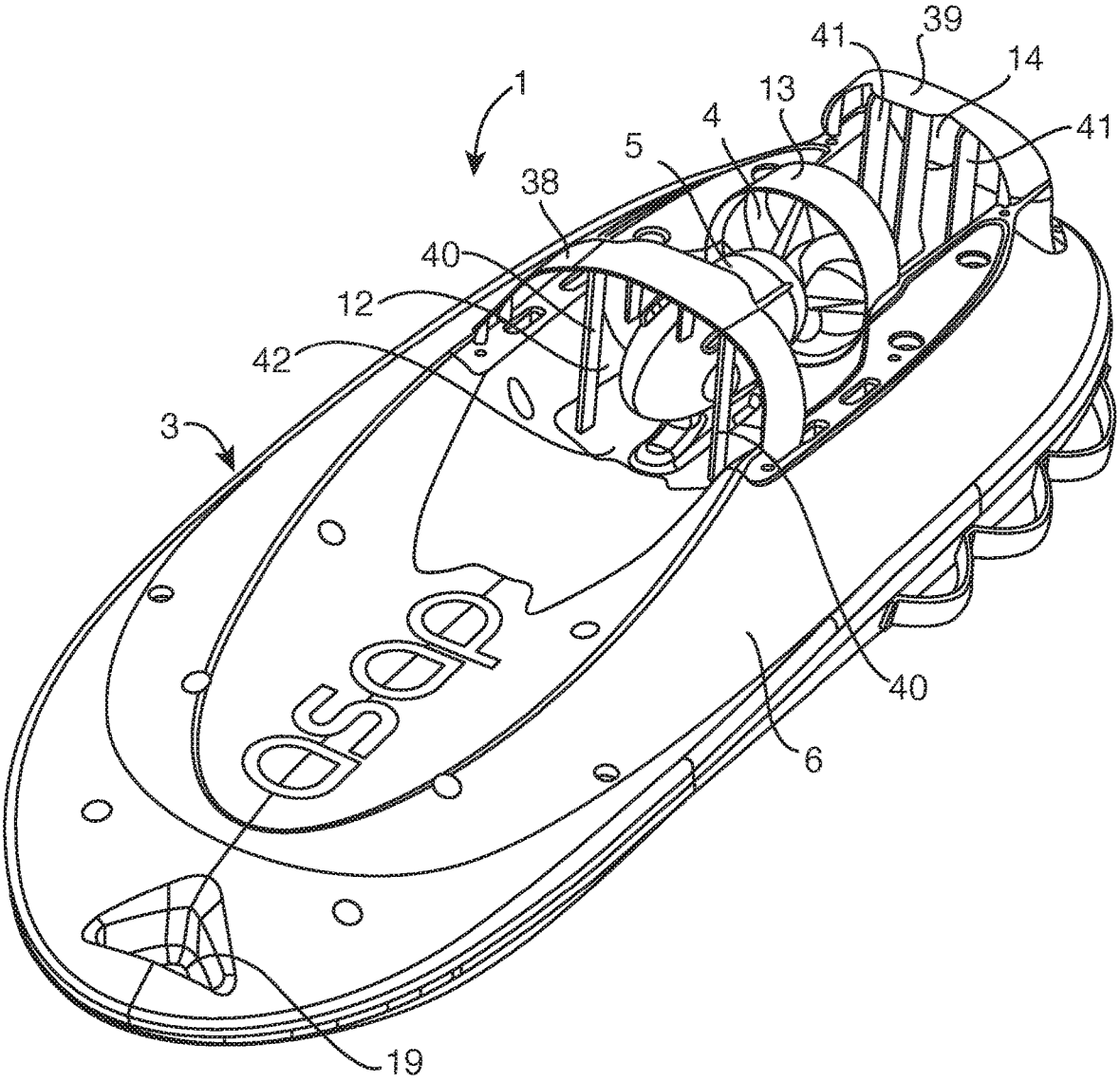
FIG. 5 is a perspective view of the underside of the powered watercraft from its left-hand side, with a cowling to its propulsion unit removed.

Referring to FIGS. 1 to 5, the powered watercraft 1, which is for the support and surface-transport in sea- or fresh-water of a user lying prone lengthwise on the upper surface 2 of the craft 1, has a hull 3 which in this example has a length of 1.4 metres and a width of 0.5 metres. Propulsion of the craft 1 is by a rearwardly-facing shrouded-propeller 4 (see FIGS. 4-6) of aluminium that is driven by a battery-powered electric motor 5 mounted on the underside 6 of the hull 3. The propeller 4 and motor 5 are located rearwardly of the craft 1 in a duct 7 which is defined within a cowling 8 that is removably-secured to the hull 3; FIG. 5 shows the craft 1 with the cowling 8 removed.

The motor 5 is powered by a battery (not shown) and is controlled by the user through hand operation of two sets of lever-mechanisms 9 (FIGS. 1-4 and 6). The two sets of mechanisms 9 are mounted on respective hand-grips 10 which project laterally either side of the craft 1 over scooped-out formations 11 of the hull 3. The user holds the grips 10, one in each hand, while operating the lever-mechanisms 9 by his/her fingers and/or thumbs to switch power to the motor 5 on/off and to regulate the speed with which the motor 5 rotates the propeller 4. Rotation of the propeller 4 draws water into the duct 7 through an inlet 12 for forceful ejection by the rotating propeller 4 from within its shroud 13, through an outlet 14 of the duct 7. This propels the craft 1 forward with thrust dependent on the user's regulation of the speed of the motor 5 using the lever mechanisms 9.

Steering of the craft 1 is achieved by the user while lying prone on the upper surface 2 holding the hand-grips 10, moving his/her weight between right- and left-hand sides of the craft 1 according to whether turning is to be to the right or to the left. Additional facility for steering may be included.

Recesses 15 in the upper surface 2 of the craft 1 enable it to be readily carried by hand when tipped onto one or other of its sides, and a handle recess 19 (see FIG. 5) is available at the front of the underside of the hull 3 for dragging the craft 1 tipped upwards. As an alternative, carrying of the craft 1 when out of the water may be by two or more individuals holding loop-handles 16 attached to the two sides of the craft 1. The handles 16 are also convenient for handling the craft 1 when it is in the water, and may be used to assist boarding the craft 1 and as hand-holds for swimmers. The handles 16 furthermore, may be used advantageously as hand-holds in the context of rescue operations carried out using the craft 1. In this latter regard also, a U-shape float 17 is releasably-retained fitted into the upper surface 2 towards the rear of the craft 1, and when released can be used as a floatation aid for upholding those in distress and corralling them together, whether conscious or otherwise, within the 'U' for towing ashore with the ends of legs 18 of the float 17 roped to the craft 1.

Figure 6:
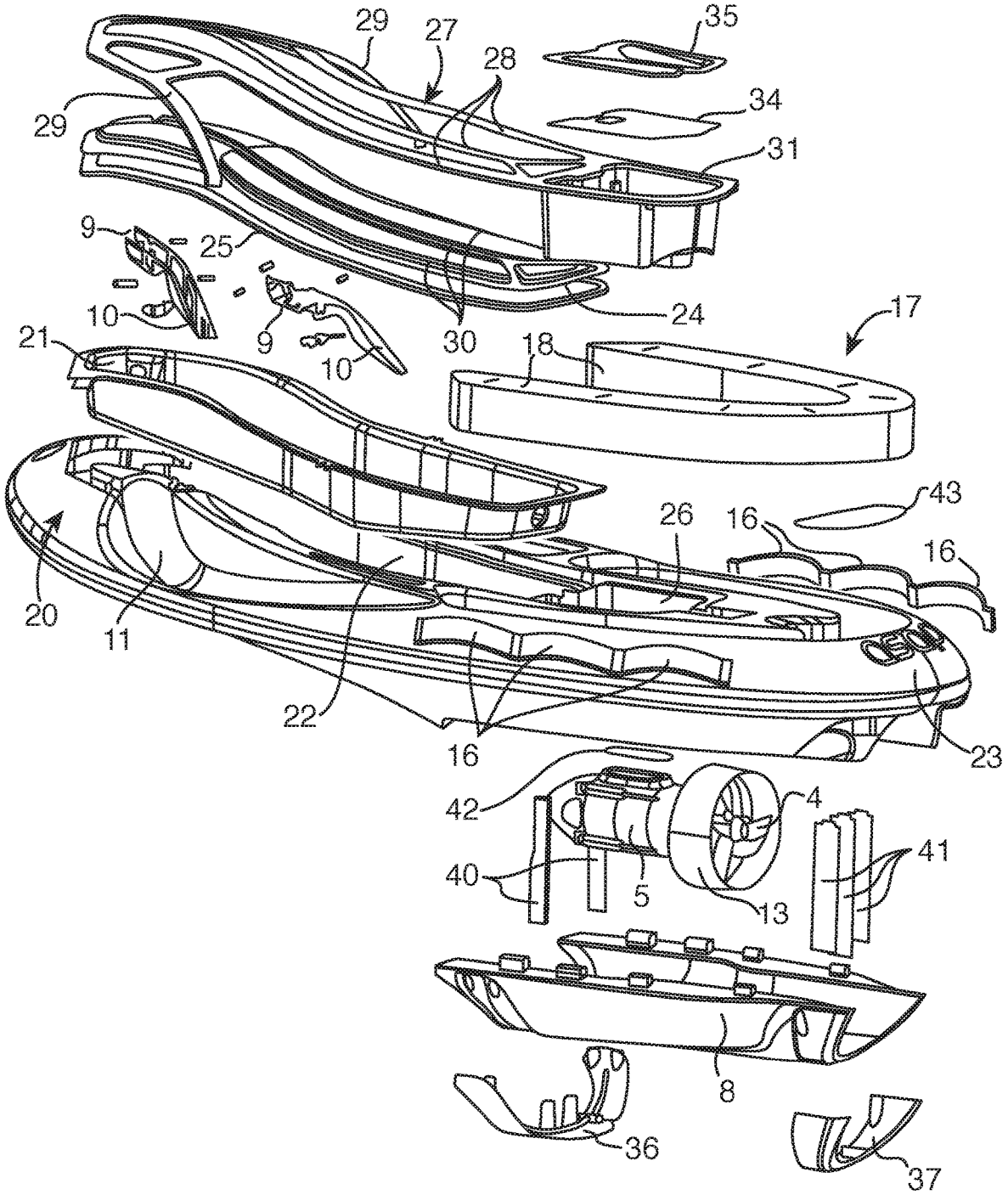
FIG. 6 is an exploded view in perspective of the powered watercraft of FIGS. 1 to 5.

Referring now also especially to FIG. 6, the hull 3 is principally a moulded shell 20 that, like the float 17 in this embodiment of the invention, is a solid-wall moulding of expanded polypropylene or other dense foam material. As illustrated in FIG. 6, an elongate open-top container 21 that is vacuum-formed of acrylonitrile butadiene styrene, is retained in a cavity 22 centrally of the shell 20 to be partly embraced by a rear, U-shape cavity 23 for receiving and retaining the float 17. A vacuum-formed polycarbonate cover sheet 24 is sealed on a gasket 25 over the top of the container 21 for watertight protection of the re-chargeable electric battery (not shown) and battery-management electronics (not shown) contained within the container 21. The container 21 when fitted in the cavity 22 aligns with a central cavity 26 of the shell 20.

An aluminium framework or skeleton 27 comprising longitudinal stretchers 28 and laterally-extending arms 29 are received within conformal grooving 30 of the cover sheet 24 to be tightly retained in the grooving 30 flush with the upper surface of the sheet 24. This affords longitudinal and lateral structural strengthening to the shell 20 additional to that provided by the polycarbonate sheet 24. It is to the free ends of the laterally-extending arms 29 of the aluminium skeleton 27 that the handgrips 10 and the lever-mechanisms 9 are securely attached.

The skeleton 27 incorporates an aluminium, open-top box 31 at its rear end that fits closely within the cavity 26 to house electronic controls (not shown) for the electric motor 5. The battery, which may be re-charged via a socket 32 on the right-hand side of the craft 1, or otherwise, powers the electric motor 5 and an LED lighting unit 33 (see FIG. 1) at the front of the craft 1.

The box 31 is sealed watertight using a top-cover 34 over the electronic controls for the motor 5, and a plate 35 having top-surface mouldings matched to the configuration of the skeleton 27, is closed over the cover 34.

The motor 5 and the shrouded propeller 4 driven directly by it, are mounted on the underside of the shell 20 within the duct 7 which is defined between the underside of the shell 20 and the cowling 8 when fitted. Metal plates 36 and 37 are fitted to opposite ends of the cowling 8 for strengthening purposes and for protecting the cowling 8 when there is grounding of the craft 1 during use.

Fitting of the cowling 8 to the hull 3 to establish the duct 7 is onto bowed metal frames 38 and 39 that are located at the inlet 12 and outlet 14 respectively of the duct 7. The frame 38 provides support for protective metal slats 40 of the inlet 12, whereas the frame 39 provides support for protective metal slats 41 of the outlet 14.

The flow of water through the duct 7 between the inlet 12 and outlet 14 is effective to cool the motor 5, and also enables heat generated by the motor-control electronics within the aluminium box 31 to be dissipated from the bottom of the box 31 via a heat-sink plate 42 (see FIGS. 5 and 6) exposed directly to the water flow. Additional dissipation of heat takes place via the bowed metal frame 38 and the front plate 36, together with the metal slats 40 slotted into the frame 38 and plate 36, and also via the bowed metal frame 39 and the rear plate 37, together with the slats 41 slotted into the frame 39 and plate 37.

A bracket 43 is secured centrally at the rear of the shell 20 for use as a convenient towing-attachment point.

Use of moulded expanded polypropylene for the shell 20 of the hull 3 and cowling 8 affords the craft 1 with durability and with light weight together with a degree of resilience or 'give' that reduces the likelihood of injury in the event of collision with swimmers and objects in the water. Areas of the hull 3 where strength is required, in particular, for example at the hand-grips 10, and at the mounting of the propulsion unit within the duct 7, are strengthened by the aluminium skeleton 27, namely via the stretchers 28, the arms 29 to which the grips 10 are attached, and via the box 31 located in the cavity 26 directly above the mounting of the propeller 4 and its motor 5.

The direct coupling of the propeller 4 to the motor 5 has the advantage of avoiding gearing between them and readily enables the bearings of the coupling to be sealed from being immersed in water; this materially reduces the likelihood of corrosion resulting from galvanic action in particular between the aluminium of the propeller 4 and steel or iron of the shaft of the motor 5 on which the propeller 4 is mounted.

The invention claimed is:

1. A powered watercraft for surface-transport on water of a prone user lying on the watercraft, the powered watercraft comprising:

a hull configured as a molded shell of expanded plastics material, and a framework extending lengthwise of the hull to strengthen the shell, the framework having two arms that extend laterally either side of the hull with hand-grips for gripping by the prone user in steering the watercraft at least in part through shift of weight of the prone user on the craft, wherein the molded shell of expanded plastics material is a solid-wall molding of the expanded plastics material.

2. The powered watercraft according to claim 1, wherein the expanded plastics material of the solid-wall molding is expanded polypropylene.

3. The powered watercraft according to claim 1, wherein the molded shell of plastics material is a solid-wall molding.

4. The powered watercraft according to claim 1, wherein the watercraft is powered by a motor-driven propeller.

5. The powered watercraft according to claim 4, wherein the motor-driven propeller is mounted within a duct on an underside of the hull.

6. The powered watercraft according to claim 4, wherein the motor-driven propeller is electrically powered from a re-chargeable battery carried by the watercraft.

7. The powered watercraft according to claim 6, wherein a speed of the motor-driven propeller is regulated via controls operated from the hand-grips.

8. The powered watercraft according to claim 1, wherein the framework is manufacture from metal.

9. The powered watercraft according to claim 8, wherein the framework is manufacture from aluminum.

10. The powered watercraft according to claim 8, wherein the framework comprises a plurality of metal elements that extend longitudinally of the molded shell, and the two arms are metal elements extending laterally from the framework.

11. The powered watercraft according to claim 10, wherein the metal elements of the framework are retained within conformal grooving of plastics material within the hull.

12. The powered watercraft according to claim 4, wherein electronic controls for the motor-driven propeller are housed in a watertight box.

13. The powered watercraft according to claim 12, wherein the watertight box is a metal box incorporated with the metal framework.

14. A powered watercraft for supporting and surface-transport of a prone user lying on the powered watercraft on water, the powered watercraft comprising:

an elongate hull comprising a molded shell of expanded plastics material;

a source of power being carried by the elongate hull for propelling the powered watercraft on water;

a framework extending lengthwise of the elongate hull for strengthening the elongate hull; and two arms extending laterally from the framework on opposite sides, respectively, of the elongate hull, each of the two arms having a hand-grip for being gripped by the prone user and steering the watercraft at least partly by shift of weight of the prone user on the powered watercraft, and wherein the molded shell of expanded plastics material comprises a solid-wall molding of the expanded plastics material.

15. The powered watercraft according to claim 14, wherein the expanded plastics material is a dense foam material.

16. The powered watercraft according to claim 15, wherein the moulded shell of plastics material is a solid-wall molding.

17. The powered watercraft according to claim 14, wherein the expanded plastics material is expanded polypropylene.

18. The powered watercraft according to claim 14, wherein the source of power is a propeller driven by a battery-powered electric motor, and the propeller is located within a water duct mounted on an underside of the elongate hull.

19. A powered watercraft for surface-transport on water of a prone user lying on the watercraft, the powered watercraft comprising:

a hull configured as a molded shell of expanded plastics material; and a framework extending lengthwise of the hull to strengthen the shell, the framework having two arms that extend laterally either side of the hull with hand-grips for gripping by the prone user in steering the watercraft at least in part through shift weight of the prone user on the craft;

wherein the watercraft is powered by a motor-driven propeller;

electronic controls for the motor-driven propeller are housed in a watertight box;

the watertight box is a metal box incorporated with the metal framework; and a heat-sink plate, for dissipation of heat from the watertight metal box, is located on an underside of the hull in a water-flow path.

20. A powered watercraft for supporting and surface-transport of a prone user lying on the powered watercraft on water, the powered watercraft comprising:

an elongate hull comprising a molded shell of expanded plastics material a source of power being carried by the elongate hull for propelling the powered watercraft on water; and a framework extending lengthwise of the elongate hull for strengthening the elongate hull;

wherein two arms extending laterally from the framework on opposite sides, respectively, of the elongate hull, each of the two arms having a hand-grip for being gripped by the prone user and steering the watercraft at least partly by shift of weight of the prone user on the powered watercraft;

the source of power is a propeller driven by a battery-powered electric motor, the propeller is located within a water duct mounted on an underside of the elongate hull; and a metal plate is located in the water duct to provide a heat sink for dissipating heat from the battery-powered electric motor.

* * * * *